US009723406B2

(12) United States Patent
Le Nerriec et al.

(10) Patent No.: US 9,723,406 B2
(45) Date of Patent: Aug. 1, 2017

(54) SYSTEM AND METHOD FOR CHANGING A CHANNEL CONFIGURATION OF A SET OF AUDIO OUTPUT DEVICES

(71) Applicant: QUALCOMM Incorporated, San Diego, CA (US)

(72) Inventors: Johan Le Nerriec, San Francisco, CA (US); Judah John Menter, Austin, TX (US); Daniel Tai, Union City, CA (US); Matthew Daniel Smith, San Jose, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/601,510

(22) Filed: Jan. 21, 2015

(65) Prior Publication Data

US 2016/0212534 A1 Jul. 21, 2016

(51) Int. Cl.
*H04R 3/12* (2006.01)

(52) U.S. Cl.
CPC ..... *H04R 3/12* (2013.01); *H04R 2227/003* (2013.01); *H04R 2227/005* (2013.01); *H04R 2420/01* (2013.01)

(58) Field of Classification Search
None
See application file for complete search history.

(56) References Cited

U.S. PATENT DOCUMENTS 5,285,521 A 2/1994 Holt et al.
5,426,339 A 6/1995 Wright
5,675,708 A 10/1997 Fitzpatrick et al.
5,729,694 A 3/1998 Holzrichter et al.
6,404,886 B1 6/2002 Yoshida et al.
6,505,154 B1 1/2003 Bottenbruch et al.
6,614,912 B1 9/2003 Yamada et al.
7,135,635 B2 11/2006 Childs et al.
7,138,575 B2 11/2006 Childs et al.
7,283,635 B1 10/2007 Anderson et al.
7,415,124 B2 8/2008 Colich
7,561,698 B1 7/2009 Pomerantz
8,208,645 B2 6/2012 Ingalls et al.
(Continued)

FOREIGN PATENT DOCUMENTS

EP 2393313 A2 12/2011
EP 2753095 A2 7/2014
(Continued)

OTHER PUBLICATIONS

WISA: "Easy Setup and Optimization," Retrieved on Aug. 4, 2014, pp. 2, Retrieved from URL: http://www.wisaassociation.org/Compliance/System-Set-up.aspx.
(Continued)

*Primary Examiner* — Paul Huber
(74) *Attorney, Agent, or Firm* — Paradice and Li, LLP

(57) ABSTRACT

A set of audio output devices may be established and configured to output channel specific audio. Once established, the channel configuration may be changed and updated in response to events such as changes to user preference, or the addition or subtraction of audio output devices to the network. In some embodiments, the reconfiguration may be performed on the fly while audio content is being outputted by the audio output devices.

20 Claims, 8 Drawing Sheets

(56) References Cited

U.S. PATENT DOCUMENTS

| | | | | |
|---|---|---|---|---|
| 8,247,677 | B2 | 8/2012 | Ludwig | |
| 8,311,226 | B2 | 11/2012 | Lorgeoux et al. | |
| 8,320,824 | B2 | 11/2012 | Banks et al. | |
| 8,724,600 | B2 | 5/2014 | Ramsay et al. | |
| 8,737,638 | B2 | 5/2014 | Sakurada et al. | |
| 9,167,339 | B2 | 10/2015 | Knox et al. | |
| 9,294,860 | B1 | 3/2016 | Carlson | |
| 9,319,794 | B2 | 4/2016 | Betlehem et al. | |
| 9,324,322 | B1 | 4/2016 | Torok et al. | |
| 2003/0026169 | A1 | 2/2003 | Schultz | |
| 2003/0220705 | A1 | 11/2003 | Ibey | |
| 2007/0160225 | A1* | 7/2007 | Seydoux | H04W 8/005 381/79 |
| 2007/0189549 | A1 | 8/2007 | Scheel et al. | |
| 2008/0114605 | A1 | 5/2008 | Wu et al. | |
| 2010/0014685 | A1 | 1/2010 | Wurm | |
| 2010/0260348 | A1 | 10/2010 | Bhow et al. | |
| 2011/0164188 | A1 | 7/2011 | Karaoguz et al. | |
| 2013/0117032 | A1 | 5/2013 | Ip et al. | |
| 2013/0170647 | A1 | 7/2013 | Reilly et al. | |
| 2013/0243199 | A1 | 9/2013 | Kallai et al. | |
| 2014/0146970 | A1 | 5/2014 | Kim et al. | |
| 2014/0233759 | A1 | 8/2014 | McCollough et al. | |
| 2014/0270187 | A1 | 9/2014 | Hall et al. | |
| 2014/0270282 | A1 | 9/2014 | Tammi et al. | |
| 2014/0277653 | A1 | 9/2014 | Watts et al. | |
| 2014/0316543 | A1 | 10/2014 | Sharma et al. | |
| 2015/0131820 | A1 | 5/2015 | Veneri et al. | |
| 2015/0279374 | A1 | 10/2015 | Roblek et al. | |
| 2015/0289038 | A1 | 10/2015 | Zartarian et al. | |
| 2015/0381296 | A1 | 12/2015 | Jenq et al. | |
| 2015/0382128 | A1 | 12/2015 | Ridihalgh et al. | |
| 2016/0044394 | A1 | 2/2016 | Derom | |
| 2016/0212535 | A1 | 7/2016 | Le Nerriec et al. | |

FOREIGN PATENT DOCUMENTS

| | | | |
|---|---|---|---|
| WO | WO-2007028094 | A1 | 3/2007 |
| WO | WO-2013022483 | A1 | 2/2013 |

OTHER PUBLICATIONS

International Search Report and Written Opinion—PCT/US2016/012088—ISA/EPO—Apr. 5, 2016.

* cited by examiner

SYSTEM AND METHOD FOR CHANGING A CHANNEL CONFIGURATION OF A SET OF AUDIO OUTPUT DEVICES

BACKGROUND

Audio systems exist that utilize network connected audio output devices (e.g., speakers). In such systems, multiple connected speakers may be used to output the same content.

DETAILED DESCRIPTION

Figure 1:
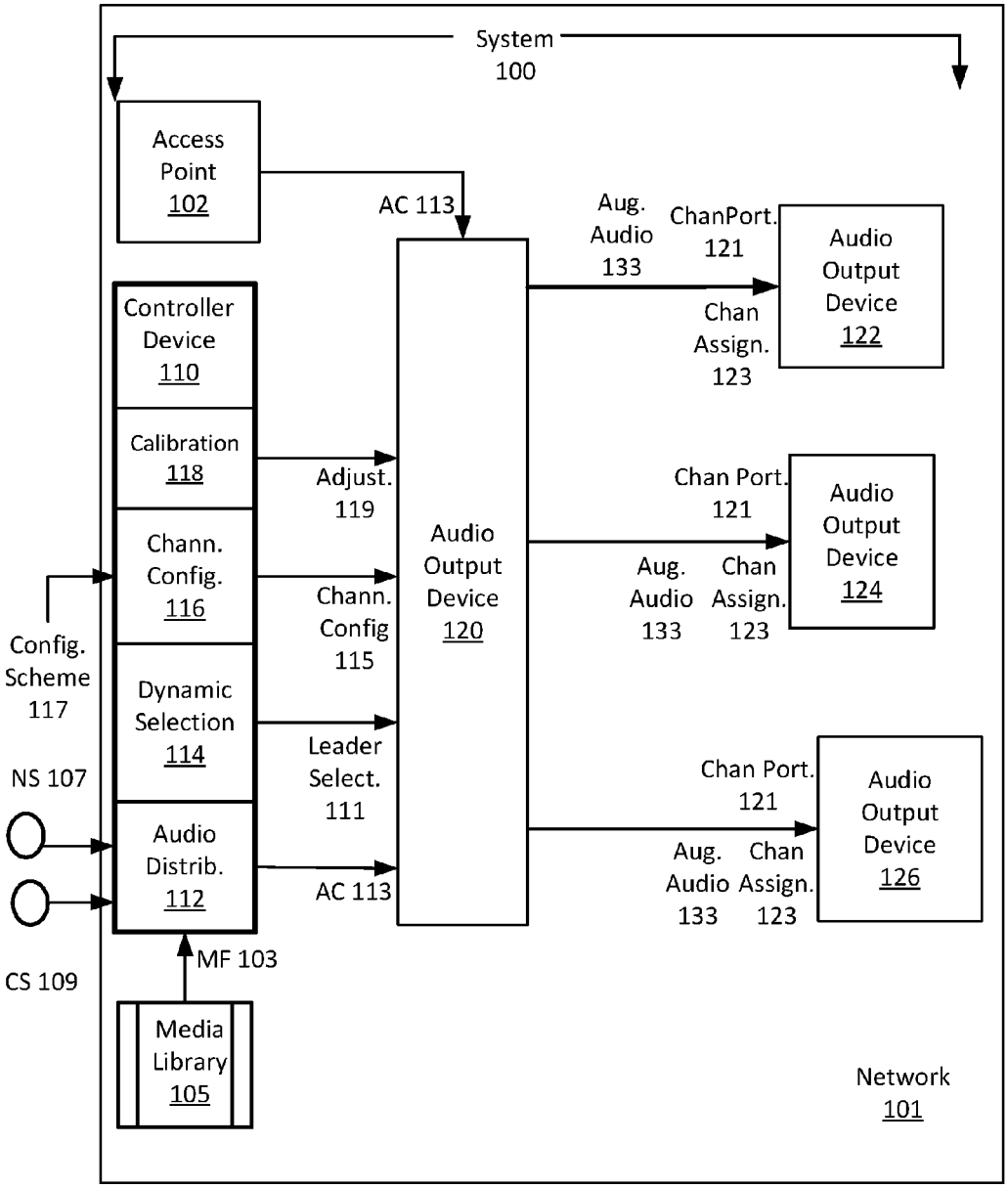
FIG. 1 illustrates a network-based audio output system that is capable of dynamic configuration and/or calibration, according to various embodiments.

According to some embodiments, a set of audio output devices may be established and configured to output channel specific audio. Once established, the channel configuration may be changed and updated in response to events such as changes to user preference, or the addition or subtraction of audio output devices to the network. In some embodiments, the reconfiguration may be performed on the fly while audio content is being outputted by the devices.

In some embodiments, the audio output devices may be controlled so that the output of the device is calibrated to the position of the user. In particular, the arrival time and/or volume of the audio may be calibrated so that the user experiences the output from perspective of being equally separated from each audio output device, with each audio output device providing a uniform audio output.

Embodiments described herein provide for a system, method, and device for outputting audio content over a network. In some embodiments, multiple audio output devices that are connected on a network to form an audio output set for receiving and outputting at least a portion of an audio content originating from a source. A controller device may determine a channel configuration for the audio output set. The channel configuration may include a channel assignment for each audio output device that is connected on the network to form the audio output set. When the audio content is being outputted, the controller device may respond to an event or condition by changing the channel configuration.

In some embodiments, a controller device determines a channel configuration for the audio output set. The channel configuration may include a channel assignment for each audio output device that is connected on the network to form the audio output set. The controller device receives audio content from a source, and outputs a channel portion of the audio content based on a channel assignment of the given audio output device. For each of the other audio output devices, the controller device communicates at least another portion of the audio content to the other audio output device. Additionally, the controller responds to an event or condition by changing the channel configuration and then outputting the channel portion of the audio content based on the new channel assignments.

In some embodiments, each of multiple audio output devices is triggered to generate an acoustic identification signal. A controller device may perform a comparison of the acoustic identification signal from each of the multiple audio output devices. The output from one or multiple audio output devices is controlled based on the comparison.

As used herein, a speaker is intended to mean an audio output device, such as a network-connected audio output device. One example of a speaker includes a dedicated device that outputs audio such as music. Another non-limiting example of a speaker includes a multifunctional device, such as a mobile device or tablet, which may output video, capture and store audio content, enable user interaction and/or perform numerous other actions.

Various embodiments described herein provide that methods, techniques, and actions performed by a computing device are performed programmatically, or as a computer-implemented method. Programmatically means through the use of code, or computer-executable instructions. A programmatically performed step may or may not be automatic.

Various embodiments described herein may be implemented using programmatic modules or components. A programmatic module or component may include a program, a subroutine, a portion of a program, or software or a hardware component capable of performing one or more stated tasks or functions. As used herein, a module or component may exist on a hardware component independently of other modules or components. Alternatively, a module or component may be a shared element or process of other modules, programs, or machines.

Furthermore, various embodiments described herein may be implemented through instructions that are executable by one or more processors. These instructions may be carried on a computer-readable medium. Machines shown or described with figures below provide examples of processing resources and computer-readable mediums on which instructions for implementing embodiments of the invention may be carried and/or executed. In particular, the numerous machines shown with embodiments of the invention include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash or solid state memory (such as carried on many cell phones and consumer electronic devices), and magnetic memory. Computers, terminals, network enabled devices (e.g., mobile devices such as cell phones) are all examples of machines and devices that utilize processors, memory, and instructions stored on computer-readable mediums. Additionally, embodiments may be implemented in the form of computer-programs, or a computer usable carrier medium capable of carrying such a program.

System Description

FIG. 1 illustrates a network-based audio output system 100 that is capable of dynamic configuration and/or calibration, according to various embodiments. The audio output system 100 may be implemented in a local or closed network 101, such as provided by a home or local area network. The network 101 may include multiple connected devices, including a controller device 110 and multiple network enabled audio output devices 120, 122, 124, and 126. In some variations, the network 101 includes an access point 102 for providing a wireless connectivity medium. By way of example, each of the controller device 110 and the audio output devices 120, 122, 124, 126 may operate under IEEE Specifications of 802.11(a), 802.11(b), 802.11(g), 802.11(n), 802.11(ac), or the like (collectively "Wi-Fi," "Wi-Fi network," or "802.11 protocol"). Still further, in some implementations, the controller device 110 and/or some or all of the audio output devices 120, 122, 124, 126 are capable of wireless peer-to-peer communications, such as provided by Wi-Fi Direct. Still further, some or all of the audio output devices 120, 122, 124, and 126 may be able to communicate directly with other devices on the network as peers. By way of example, the individual audio output devices 120, 122, 124, and 126 may communicate using a direct, wireless peer-to-peer communication protocol, such as provided by Wi-Fi Direct. Still further, in some variations, one or more of the audio output devices 120, 122, 124, and 126 may utilize a connectivity medium such as provided through an Ethernet connection or other network-based wired connection.

The audio output devices 120, 122, 124, and 126 may be connected and positioned in a physical region of the network 101, based on preference of a user. A physical region of the network 101 may correspond to a dwelling, or alternatively, to a room or space within the dwelling. By way of example, an environment of the network 101 can correspond to a home network in which multiple speakers or other audio output devices are provided with network connectivity for purposes of outputting audio content selected by the user. In this context, the user may selectively position individual connected speakers about a room to enhance the user's enjoyment of rendered audio content.

In some embodiments, the audio output devices 120, 122, 124, and 126 may be heterogeneous in nature, meaning that the audio output devices 120, 122, 124, and 126 may have different manufacturers, capabilities, resources and/or purposes. For example, one or more of the audio output devices 120, 122, 124, and 126 may correspond to a television, for which audio output is not a primary purpose. One or more of the audio output devices 120, 122, 124, and 126 may also include programming or other logic to enable that audio output device to communicate with other devices on the network. An example of such programming or logic includes ALLPLAY platform, manufactured by QUALCOMM CONNECTED EXPERIENCES, which may be installed or otherwise provided through firmware on wireless speakers. While some examples describe audio output devices 120, 122, 124, and 126 as speakers (or dedicated audio output devices), other variations provide for audio output devices 120, 122, 124, and 126 which have multi-purposes, including televisions, desktop computers, or other multifunction audio output devices.

The controller device 110 operates to execute an application, software platform, or other programming logic in order to communicate with and control the audio output devices 120, 122, 124, and 126. By way of example, the controller device 110 may correspond to a mobile computing device, such as a multifunction cellular telephony/messaging device, tablet, hybrid device (so called "phablet"), or wearable computing device.

The controller device 110 may operate to control and configure the output of audio using the audio output devices 120, 122, 124, and 126. Any one of multiple audio distribution configurations may be used for purpose of outputting the audio content on multiple audio output devices 120, 122, 124, and 126 in accordance with a dynamically selected channel configuration. In some embodiments, the controller device 110 may be operated modally in order to select from multiple possible audio distribution configurations.

The controller device 110 distributes audio content ("AC") 113 directly or indirectly to each of the multiple audio output devices 120, 122, 124, or 126. In some implementations, the controller device 110 is the source of the audio content 113 being distributed. For example, the audio content 113 may correspond to media files ("MF") 103 that are accessed from a media library 105 of the user. Depending on implementation, the media library 105 may be local to the controller device 110, distributed amongst multiple devices on the network 101, or remote to the controller device 110. For example, some or all of the media library 105 may be stored on other devices (including one or more of the audio output devices 120, 122, 124, or 126) or resources of the network 101, and the controller device 110 may communicate with another device on the network 101 (e.g., home computer, cable box, etc.) in order to retrieve media files 103 from the media library 105. Still further, the controller device 110 may access network services ("NS") 107 for the audio content 113, such as online media sites (e.g., PANDORA, SPOTIFY, GOOGLE PLUS, etc.). The controller device 110 may also generate audio content 113 from other content sources ("CS") 109, such as cable, satellite or over-the-air broadcasts. Additionally, the controller device 110 may distribute the audio content 113 originating from multimedia content that is rendered on the device. For example, the controller device 110 may execute different applications which generate multimedia content (e.g., games), and audio from these active applications may be distributed as the audio content 113. In other variations, the controller device 110 may access another device or resource on the network 101, such as a device that communicates with one or more of the audio output devices 120, 122, 124, or 126 through the access point 102. Depending on the capabilities of the respective devices, the controller device 110 may use peer-to-peer wireless communications (e.g., Wi-Fi Direct) in order directly transmit the audio content 113 to each of the desired audio output devices 120, 122, 124, and 126 on the network 101.

In some implementations, the controller device 110 distributes the audio content 113 through one of the audio output devices 120, 122, 124, 126 that implement functionality for operating as the leader of the active output devices on the network 101. The controller device 110 may select one of the audio output devices 120, 122, 124, 126 to serve as the leader device. In an example of FIG. 1, the audio output device 120 that is selected as the leader may receive the audio content 113 from the controller device 110 (which may access the media library 105, network service 107 or content source 109) for distribution to the other audio output devices 122, 124, 126. In variations, the audio output device 120 may receive the audio content 113 from another source (e.g., another device of network 101), under direction or control of the controller device 110, for distribution to the other audio output devices 122, 124, 126.

In alternative variations or modes, either the controller device 110 or the audio output device 120 that operates as the leader may channel-filter or augment the audio content 113 for transmission to the respective audio output devices. When channel filtered, the audio content 113 may be delineated into multiple channel portions 121, and each channel portion 121 of the audio content 113 is communicated to an assigned audio output device 120, 122, 124, and 126. When augmented, the audio content 113 may be pre-structured into channeled components, and the augmented audio ("aug. audio") 133 may be transmitted to the other audio output devices 122, 124, 126 where the augmented audio 133 is filtered into a corresponding channel portion 121.

Figure 2:
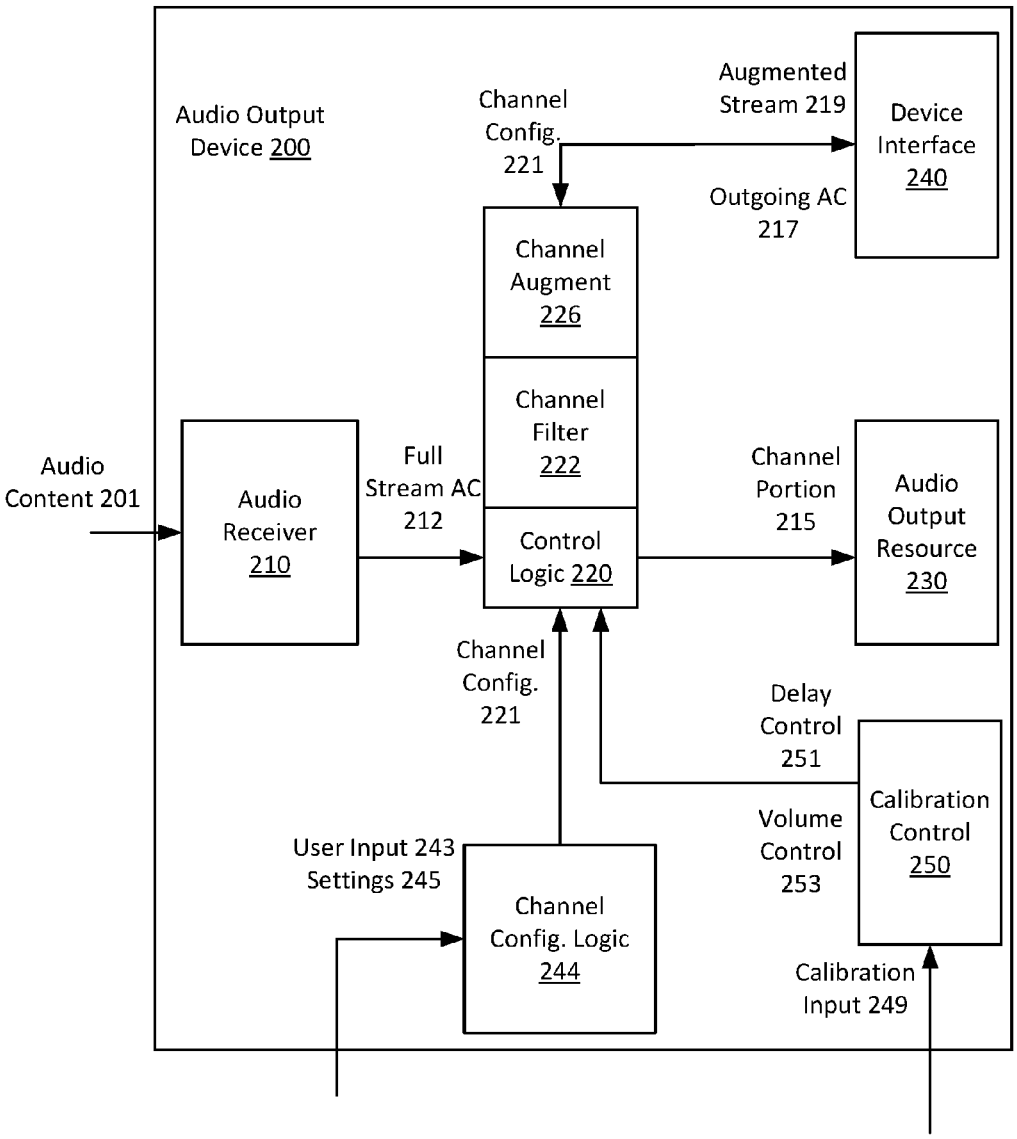
FIG. 2 illustrates an audio output device that is capable of being selected and operated as a leader device according to various embodiments.

In an example of FIG. 1, the controller device 110 includes an audio distribution logic 112, a dynamic selection logic 114, a channel configuration logic 116, and a calibration logic 118. Furthermore, in an example of FIG. 1, one or more of the audio output devices 120, 122, 124, and 126 may be selected to implement the functionality of the leader, which may include components and functionality (e.g., as described with an example of FIG. 2). The functionality, shown to be described with either the controller device 110 or the audio output device 120 that is selected as the leader, may be interchangeable amongst the two devices (or amongst another device that may be substituted as the leader for the audio output device 120). For example, in some variations, the controller device 110 may include functionality for implementing channel filtering or channel augmentation (e.g., as shown in FIG. 2). Likewise, in some variations, the audio output device 120 may operate as the leader and also include one or more of the components of the controller device 110, such as one or more of the dynamic selection logic 114, channel configuration logic 116, or calibration logic 118.

According to some embodiments, the controller device 110 includes the channel configuration logic 116 for performing operations to determine a channel configuration 115 of the set of audio output devices 120, 122, 124, and 126. The channel configuration 115 may be determined by (i) a number of available audio output devices 120, 122, 124, and 126, (ii) a configuration scheme 117 or layout that is based on preference and/or the number of available audio output devices 120, 122, 124, and 126, and/or (iii) the relative positioning of each audio output device 120, 122, 124, and 126 within the space or environment of the network 101. Accordingly, the channel configuration 115 may specify channel assignments 123 for each audio output device 120, 122, 124, and 126, given a desired configuration scheme 117 and the relative positioning of the audio output devices. Once determined, channel assignments 123 may be communicated to the audio output devices 122, 124, 126 as control or command data. Depending on implementation or mode of operation, the channel assignments 123 may be communicated directly from the controller device 110 or from the audio output device 120 that is acting as the leader. As described with various examples, the channel configuration logic 116 may dynamically re-determine and implement the channel configuration 115 based on the occurrence of conditions and events that affect usage of the audio output devices 120, 122, 124, and 126 on the network 101.

Still further, in some variations, the controller device 110 may have different modes of operation in order to implement an audio distribution configuration in which the audio distribution logic 112 directly distributes the audio content 113 to each of the audio output devices 120, 122, 124, and 126. The audio distribution logic 112 of the controller device 110 may communicate either a full or partial stream to multiple audio output devices.

According to variations, in an alternative mode, the controller device 110 may use the dynamic selection logic 114 to select one of the multiple audio output devices 120, 122, 124, 126 as a leader. In some variations, the determination to use the particular audio output device 120 as the leader may be made programmatically, based on, for example, available resources of the controller device 110 and/or preferences of the user. Various criteria may be used to select one audio output device 120 as the leader for the other audio output devices 122, 124, or 126 of the network 101. Among the criteria, the audio output device 120, 122, 124, and 126 that is selected to be the leader may be required to have a minimum set of resources, such as a minimum processing capability and/or the ability to establish multiple simultaneous peer-to-peer connections with other devices on the network 101. Alternatively, the audio output device 120 that is selected as the leader may have the most or best of a desired resource or capability. For example, the audio output device 120 may be selected as the leader because the audio output device 120 satisfies a criterion of containing digital signal processor ("DSP"), or because the audio output 120 device is deemed to have the greatest amount of available bandwidth as compared to the other audio output devices.

In some variations, the control device 110 may communicate a leader selection 111 to the selected audio output device 120, 122, 124, or 126. In some embodiments, the controller device 110 makes the leader selection 111 programmatically using for example, the dynamic selection logic 114.

In some implementations, the audio output device 120 receives the audio content 113 from a content source (CS) 109, and then distributes the audio content 113 as the channel portions 121 to each of the other audio output devices 122, 124, 126 of the network 101. The source of the audio content 113 may, for example, correspond to controller device 110. For example, controller device 110 may generate the audio content 113 (e.g., gaming content) and/or store portions of the media library 105, such as a library of songs or albums, and the audio content 113 may correspond to a media file 103 from the media library 105. Alternatively, controller device 110 may also serve as a source for audio content retrieved from both local network and remote sources. For example, the controller device 110 may access other media resource devices (e.g., home computer, cable box, etc.) on the network 101 in order to retrieve the media files 103 of the user's media library. Still further, the controller device 110 may access commercially available third party network services 107 for the audio content 113 (e.g., PANDORA, SPOTIFY, GOOGLE PLUS, etc.). In other variations, the content source 109 for the audio content 113 may be another device on the network 101, such as a device that communicates with the controller device 110 and/or output device 120 through the wireless access point 102. Still further, in other variations, the source of the audio content 113 may be another content source 109 (e.g., cable or over-the-air broadcast) available through the network 101.

According to some variations, the audio output device 120 processes the audio content 113 (audio data) to delineate the channel portions 121 from the audio content 113. Each channel portion 121 may then be communicated to corresponding audio output device 122, 124, 126. The channel portion 121 for the audio output device 120 may be played using a local audio output resource, in concert with the playback of the channel portions 121 of the other audio output devices 122, 124, 126.

According to some embodiments, the channel configuration 115 may be dynamically determined on the fly, based on conditions or events detected on the network 101. For example, the controller device 110 may detect a particular network condition (e.g., limited bandwidth) and then output the channel configuration 115 to include an alternative set of channel assignments 123 for the respective audio output devices 120, 122, 124, and 126. Still further, the controller device 110 may receive input, or otherwise detect the addition or subtraction of an audio output device 122, 124, or 126, so as to affect a number of audio output devices 120, 122, 124, and 126 that are in use. In some cases, a change in the number of audio output devices 120, 122, 124, and 126 that are in use may also change the configuration scheme 117 (e.g., from 7.1 to 5.1) and/or require further changes to the channel assignment 123, in order to accommodate a different number of audio output devices 120, 122, 124, and 126 that are in use (or available for use) on the network 101. The ability of the controller device 110 to dynamically determine and implement channel configurations may enable, for example, playback of the audio content from some or all of the audio output devices 120, 122, 124, and 126 to continue substantially uninterrupted while one or more channel assignments 123 takes place. In addition to dynamically determining the channel configuration 115, the controller device 110 may dynamically select the audio output device 120 that is the leader. The determination of which audio output device 120 serves as the leader may be based on, for example, the available bandwidth for each of audio output device 120, 122, 124, or 126 that satisfy one or more criteria for being the leader.

As still another example, the modal operation of the controller device 110 in distributing the audio content 113 may also be dynamically changed. For example, the controller device 110 may switch from using one audio output device 120 as the leader to directly transmitting the audio content 113 (or channel portions 121 thereof) to each audio output device 120, 122, 124, and 126. Still further, the selection of which audio output device 120, 122, 124, 126 serves as the leader may also be dynamic, based on factors such as the available bandwidth to the respective audio output devices 120, 122, 124, 126.

In some variations, the controller device 110 includes the calibration logic 118. The calibration logic 118 may operate to adjust output of the audio output devices 120, 122, 124, 126 to accommodate a relative position of the user in the physical space of the environment of the network 101. The calibration logic 118 can may operate to accommodate the proximity of the user to one or more of the audio output devices 120, 122, 124, and 126. The calibration logic 118 may implement operations so that the audio experienced by the user at a given location is uniform from all direction. In particular, the calibration logic 118 may implement adjustments 119 in the form of delays in individual audio output devices 120, 122, 124, and 126 so that the arrival time of audio transmissions from each of the respective audio output devices 120, 122, 124, 126 is near simultaneous with respect to the user, even though the user may be closer to one audio output device 120, 122, 124, 126 as compared to another. Still further, the calibration logic 118 may implement adjustments 119 in the form of volume adjustment for the individual audio output devices 120, 122, 124, 126 so that the volume experience by the user from each of the audio output devices 120, 122, 124, 126 is the same, even when the user is closer to one audio output device as compared to another.

FIG. 2 illustrates an audio output device that is capable of being selected and operated as a leader, according to various embodiments. An audio output device 200 such as shown and described with an example of FIG. 2 may operate as the audio output device 120 in the example of FIG. 1. With reference to FIGS. 1-2, in more detail, the audio output device 200 includes an audio receiver 210, control logic 220, a local an audio output resource 230, and a device interface 240. The control logic 220 may be coupled with, or include, channel filter 222 and/or channel augmentation 226.

The audio receiver 210 may receive audio content 201 from the controller device 110. Alternatively, the audio receiver 210 may receive the audio content 201 from another source, such as from an online source or from another device. The audio content 201 may be received either directly or indirectly (e.g., via an access point 102 or from the controller device 110).

The audio output device 200 may also receive channel configuration data 221 from the controller device 110 (shown via the device interface 240). In variations, the audio output device 200 includes channel configuration logic 244 for determining channel configuration data 221 independently of any communication from another device. The channel configuration logic 244 may determine channel configuration data 221 from, for example, user input 243, such as provided through the user's interaction with a user interface of the audio output device 200. The channel configuration logic 244 may also determine channel configuration data 221 based on settings 245 or preferences of the user or device.

In some implementations or modes of operation, the audio receiver 210 may communicate the full stream of audio content ("full stream AC") 212 to the channel filter 222 of control logic 220. The channel filter 222 filters the full stream of audio content 212 into channeled portions based on channel assignments defined by the channel configuration data 221. Once channels are delineated from the audio content 212, audio output resource 230 receives the channel portion 215 for the channel assigned to the audio output device 200. The portion of the outgoing audio content (AC) 217 for the channels assigned to the other audio output devices 122, 124, 126 may be transmitted to the other audio output devices via the device interface 240.

In a variation, the audio output device 200 may implement channel augmentation 226. Channel augmentation 226 may structure the audio content 212 into an augmented stream 219 that may be transmitted to the other audio output devices 122, 124, 126 via the device interface 240. The augmented stream 219 may be filtered for an appropriate channel at the corresponding audio output device 122, 124, 126, which coincides with the point of output for the particular channel output. The device interface 240 may communicate augmented stream 219, which may be filtered for a given channel. In this way, the channel augmentation 226 may provide an alternative to filtering the audio content in advance of transmission.

The device interface 240 may include programming or logic to enable audio output device 200 to be interconnected and operable with multiple other devices of different kinds on the network 101. In some implementations, the device interface 240 includes an application program interface provided through, for example, ALLPLAY, manufactured by QUALCOMM CONNECTED EXPERIENCES.

In some embodiments, the audio output device 200 includes functionality for triggering or implementing calibration control 250. In some implementations, the calibration control 250 receives calibration input 249 from another device, such as from controller device 110. In one example, controller device 110 includes resources and logic for receiving input that is indicative of calibration variations, and further includes resources and logic to determine calibration actions that may be taken on one or more of the audio output devices 120, 122, 124, 126 in order to calibrate the audio output for the location of the user. As mentioned with other examples, the calibration actions serve to affect an audio output experienced by the user, with specific consideration for a relative proximity of the user to individual audio output devices 120, 122, 124, 126 of the network 101.

In some embodiments, the calibration actions of the calibration control 250 may include delay control 251. The control logic 220 may process and communicate the delay control 251 to other audio output devices 122, 124, 126 via the device interface 240. Another example of calibration actions of calibration control 250 includes volume control 253. The control logic 220 may communicate the volume control 253 to the other audio output devices via the device interface 240.

Controller Device

Figure 3:
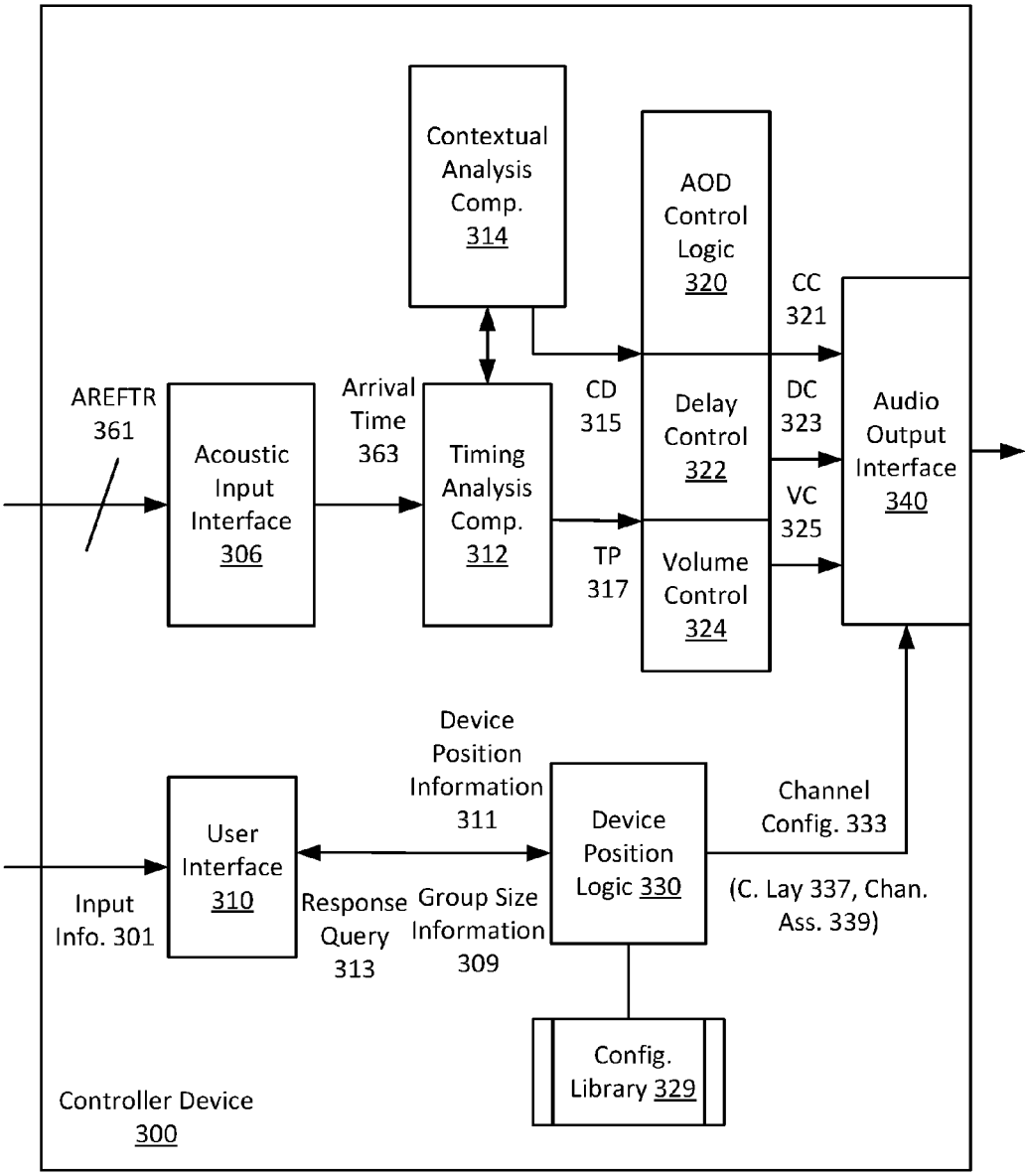
FIG. 3 illustrates an example of a controller device for use with various embodiments.

FIG. 3 illustrates an example of a controller device 300, according to various embodiments. With reference to FIGS. 1-3, according to various embodiments, the controller device 300 (which may correspond to the controller device 110) may be implemented using software that executes on a mobile computing device, such as a device that may be carried by a person within the space or physical region of the network 101. By way of example, the controller device 300 can correspond to a device such as a cellular telephony/messaging device (e.g., feature phone), tablet or hybrid device, wearable computing device, or laptop. In some embodiments, the controller device 300 operates to receive input information 301 for determining (i) a number of audio output devices 120, 122, 124, 126, 200 that are connected on the network 101, and (ii) the location of each audio output device 120, 122, 124, 126, 200 with respect to a given space of coverage within the network 101. The software that is implemented on the controller device 300 may correspond to, for example, an application, a suite of applications, or alternatively to an operating system level functionality. The controller device 300 can share an application framework or interface with other devices of the network. For example, each of the controller device 300 and the various audio output devices 120, 122, 124, 126, 200 that are employed on the network 101 may implement a media platform, such as provided by QUALCOMM ALLPLAY media platform.

As an addition or alternative, in some embodiments, the controller device 300 operates to detect and process transmissions for purpose of estimating a proximity of the controller device to individual audio output devices 120, 122, 124, 126 that are operating on the network 101. With such proximity information, the controller device 300 may operate to calibrate an output of one or more of the audio output devices 120, 122, 124, 126 on the network 101.

In some embodiments, the controller device 300 includes a user interface 310, audio output device control logic ("AOD control logic") 320, device position logic 330, and an audio output interface 340. The user interface 310 may display prompts that guide the user into providing input that identifies basic input information 301 about the audio output devices 120, 122, 124, 126 employed on the network 101. For example, the user interface 310 may display a virtualized room or space within the dwelling, and provide features that enable the user to indicate, among other information, (i) a number of audio output devices 120, 122, 124, 126 employed on the network 101, and (ii) a general location for a given audio output device 120, 122, 124, 126 which may be labeled. The user interface 310 may also execute to prompt the user to provide input information 301 that identifies additional information about the audio output devices, such as a manufacturer, capability, or connectivity status. The user interface 310 may output device position information 311, which may identify the number of audio output devices and their relative position in a space represented through the user interface 310. The device position logic 330 may receive the position information 311, and optionally generate one or more response queries 313 that may configure content on the user interface 310 to, for example, prompt the user to provide additional input information 301.

By way of example, the response queries 313 may prompt the user to provide additional input information 301 that can approximate the length or total distance between the audio output devices 120, 122, 124, 126 on the network 101, so as to provide dimensionality to the virtualized representation of the space within the network. Still further, the response query 313 may prompt the user to specify audio output devices 120, 122, 124, 126, 200 for different rooms of a dwelling of the network 101. More generally, the response query 313 may prompt the user interface 310 to display content for enabling the user to define different rooms or spaces of the dwelling covered by the network 101. In some variations, the input information 301 may prompt the user into entering information corresponding to (i) group size information 309, corresponding to a number of audio output devices on the network 101, and (ii) device position information 311, which identifies a general or relative location of audio output devices 120, 122, 124, 126 within the space of the network 101 (e.g., within the individual rooms). Still further, while some embodiments provide for the user interface 310 to prompt the user for input information 301, other embodiments provide for the user interface 310 to guide the user into selecting one or more configurations affecting the audio output devices 120, 122, 124, 126 including input for selecting channel configuration 333.

In some embodiments, the device position logic 330 may operate to determine a set of the channel configurations 333 based at least in part on the group size information 309 and the device position information 311 of the individual audio output devices 120, 122, 124, 126. The channel configuration 333 may specify a speaker configuration layout ("C. Lay") 337, such as 3, 5, 7, (or more) Surround Sound layout, or Dolby 5.1 or 7.1 speaker layout. The channel configurations 333 for the audio output devices 120, 122, 124, 126 can include channel assignments 339 ("Chan. Ass. 339") for individual audio output devices. In some variations, the configuration layout 337 may be based on one or more criterion, such as the number of audio output devices 120, 122, 124, 126 (e.g., provided with group size information 309) and/or the positioning of the audio output devices 120, 122, 124, 126 (e.g., as specified from device position information 311). In some variations, configuration layout 337 may be selected by default. In another variation, the user may be provided a selection feature via the user interface 310 in order to make selection of a particular configuration layout 337. A configuration library 329 may retain information about different possible configuration layouts 337, and provide a mechanism for selecting one or more configuration layouts 337 based on the group size information 309 and/or the device position information 311 of each audio output devices 120, 122, 124, 126. The device position information 311 of each audio output device 120, 122, 124, 126 can be also indicated by input information 301 received via the user interface 310), as well as other input from the user (e.g., input that is indicative of a preference of the user). The channel assignments 339 may be made programmatically, based on, for example, the configuration layout 337, the group size information 309, and/or device position information 311 of the audio output devices 120, 122, 124, 126 in the space of the dwelling.

The channel configuration 333 may be communicated to the audio output interface 340. As mentioned with other examples, the audio output interface 340 may provide an application programming interface that enables the controller device 300 to communicate with other connected devices of the network 101. For example, the audio output interface 340 may be used for wireless peer-to-peer communications, such as provided through a Wi-Fi Direct medium. In some variations, the audio output interface 340 communicates the channel configurations 333 to the audio output device 120, 200 that is selected to be the leader for a particular session on the network.

As mentioned, in some embodiments, the controller device 300 includes functionality for calibrating an output of the audio output devices 120, 122, 124, 126 on the network 101 based on a location of the user at a given moment. As the location of the user changes, the controller device 300 may implement functionality to dynamically control an output of individual audio output devices 120, 122, 124, 126 on the network 101, so that the audio experience of the user equally reflects the output from individual audio output devices.

In some embodiments, the controller device 300 includes an acoustic input interface 306, a timing analysis component 312, and the audio output device control logic 320. The audio output device control logic 320 may include a delay (or latency) control 322 and volume control 324. The acoustic input interface 306 may include a programming component that interfaces with a microphone of a mobile computing device on which controller device 300 is implemented. In particular, the acoustic input interface 306 may be configured to detect reference acoustic reference transmissions ("AREFTR") 361 from each of the active audio output devices 120, 122, 124, 126 on the network 101. The acoustic input interface 306 may include logic that recognizes, for example, a predetermined characteristic of the acoustic reference transmissions 361, such as a signal pattern.

In some embodiments, each audio output device 120, 122, 124, 126 transmits a locally unique acoustic reference transmission 361, signaling an identifier for the transmitting device. Depending on implementation, the acoustic reference transmission 361 of each audio output device 120, 122, 124, 126 may be in the audible or inaudible range. In some embodiments, the acoustic reference transmission 361 of the each audio output device 120, 122, 124, 126 is communicated at a frequency range that is detectable to a microphone of the mobile computing device on which the controller device 300 is provided. Additionally, each of the audio output devices 120, 122, 124, 126 communicates a corresponding acoustic reference transmission 361, representing a portion (e.g., a frame or series of frames) of an audio content (e.g., song) that is outputted from each of the respective audio output devices.

The acoustic input interface 306 may include logic to detect the acoustic reference transmission 361 from each of the audio output devices 120, 122, 124, 126. The acoustic input interface 306 may also compare the arrival time 363 of each of the acoustic reference transmissions 361 in order to determine a delay or other difference between the arrival times of the acoustic reference transmissions from different audio output devices 120, 122, 124, 126 on the network 101. By way of example, embodiments recognize that it takes sound slightly less than 1 millisecond to travel 1 foot, and that if the user moves by relatively small amounts (e.g., one foot), a detectable delay may result that affects the quality of the user experience in listening to the collective audio output from the audio output system 100.

The timing analysis component 312 may analyze the arrival time 363 of each of the acoustic reference transmissions 361 in order to detect sufficiently significant variations amongst the arrival times 363 that are attributed to the individual audio output devices 120, 122, 124, 126. The difference in arrival times 363 may be indicative of user location, and more specifically, of a relative location or proximity of the user to individual audio output devices 120, 122, 124, 126 of the system.

In some variations, a contextual analysis component 314 may also be implemented in connection with the timing analysis component 312. The contextual analysis component 314 may determine contextual information from timing differentials (as identified by arrival times 363) of the acoustic reference transmissions 361 from the different audio output devices 120, 122, 124, 126. In some variations, the contextual analysis component 314 may detect a trend or event from the movement of the user within a network space or region. For example, the contextual analysis component 314 can reference known information about the location of individual audio output devices 120, 122, 124, 126 (which may be approximated from input information 301 and/or from location detection technology) in order to determine that the user has switched rooms. Accordingly, one determination that may be made from the contextual analysis component 314 includes the determination to power down or up selected audio output devices 120, 122, 124, 126 based on the determined location of the user. The contextual analysis component 314 may signal a contextual determination ("CD") 315 to the audio output device control logic 320, which in turn may send control commands ("CC") 321 to select audio output devices 120, 122, 124, 126 for purpose of powering those audio output devices up or down based on contextual determinations 315. By way of example, the contextual determinations 315 may include information that locates a particular audio output device in one room or floor and the user in another room or floor of the dwelling.

Additionally, timing analysis component 312 may generate a timing parameter ("TP") 317 which is indicative of a difference in the arrival times 363 of one or more acoustic reference transmissions 361. The delay control 322 of the audio output device control logic 320 may utilize the timing parameter 317 to generate a delay command ("DC") 323 for one or more of the audio output devices 120, 122, 124, 126. By way of example, when output provided from the acoustic input interface 306 indicates that the user has become proximate to one of the audio output devices 120, 122, 124, 126 and distal to another of the audio output devices 120, 122, 124, 126, the proximate audio output device may be provided the delay command 323. The delay command 323 may serve to slow down or delay the output of the proximate audio output device 120, 122, 124, 126. The delay caused to the proximate audio output device 120, 122, 124, 126 may be based on the detected difference in the arrival times 363 of the acoustic reference transmissions 361 from the distal and proximate audio output devices 120, 122, 124, 126. The delay command 323 may generate a delay that substantially equalizes the arrival times 363 of the proximate and distal audio output devices 120, 122, 124, 126.

Still further, the volume control 324 of the audio output device control logic 320 may use the timing parameter 317 to determine an adjustment to the volume of one or more of the audio output devices 120, 122, 124, 126 with the purpose of having the user experience a same volume from all of the audio output devices 120, 122, 124, 126 regardless of the fact that the user may move or otherwise become close to one or more of the audio output devices at the expense of another. In some implementations, the volume control 324 may generate a volume command ("VC") 325 to cause one of (i) a decreasing adjustment to the volume of a proximate audio output device 120, 122, 124, 126 in response to user movement, and (ii) an increasing adjustment to the volume of a distal audio output device 120, 122, 124, 126, 200 in response to the user movement, or (iii) a combination of increasing and decreasing volume of the distal and proximate audio output device 120, 122, 124, 126 respectively, in response to user movement. The particular volume command 325 that is selected may be based on, for example, a default setting or a user preference.

The audio output interface 340 may communicate one or more of the control command 321, delay command 323, and/or volume command 325 to the connected audio output devices 120, 122, 124, 126 of the network 101. In particular, the delay command 323 and/or volume command 325 may be generated in response to continued polling or checking of user location as determined from the mobile computing device of controller device 300. In this way, the delay commands 323 and/or volume commands 325 may provide a mechanism to calibrate output characteristics of individual audio output devices 120, 122, 124, 126 on the network 101. Among other benefits, the calibration functionality enables the user to experience audio content as equal contributions from multiple audio output devices 120, 122, 124, 126 of the network 101 that are spaced non-equidistantly. The calibration functionality also enables the user to experience audio content from multiple contributing audio output devices 120, 122, 124, 126 equally even when the user is in motion, or when the user is measurably closer to one audio output device over another. The calibration functionality such as described may also enable the collective audio output to be equalized in contributions from the different audio output devices 120, 122, 124, 126 that are generating output on the network 101, despite differences existing in the manufacturing, quality, or capability of the individual audio output devices.

Figure 4:
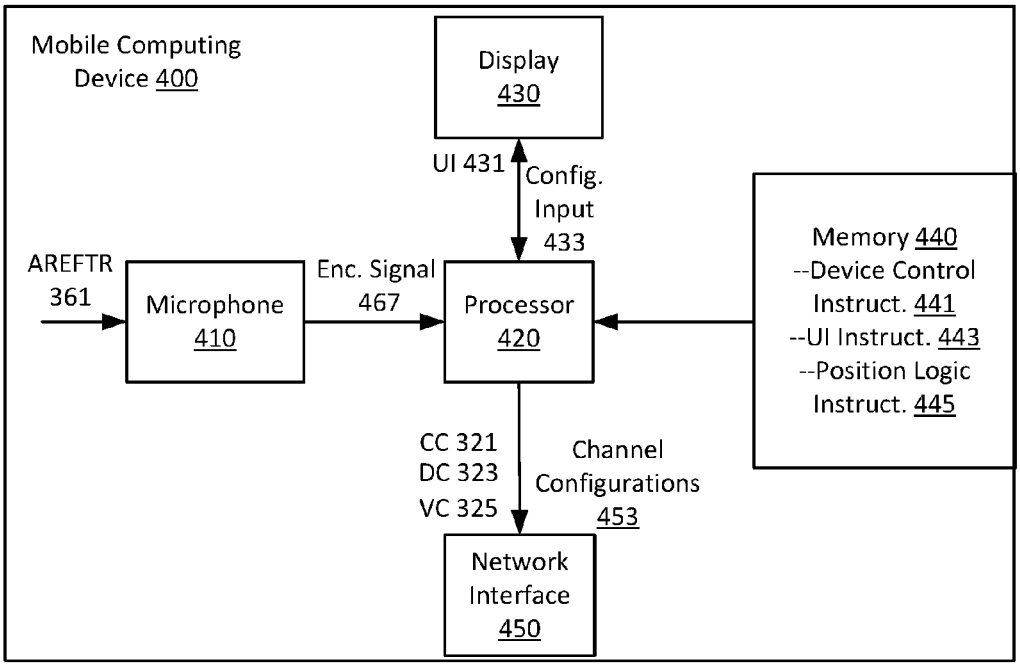
FIG. 4 illustrates a mobile computing device on which various embodiments may be implemented.

FIG. 4 illustrates a mobile computing device on which various embodiments may be implemented. A mobile computing device 400 of FIG. 4 may be used to implement controller device 110, 300, such as described with an example of FIG. 1 and FIG. 3. The mobile computing device 400 may include a microphone 410, a processor 420, a display 430, a memory 440, and a network interface 450.

With reference to FIGS. 1-4, the memory 440 may store instructions for implementing various functionality described with, for example, controller device 110, 300. In some variations, the memory 440 stores device control instructions ("Device Control Instruct.") 441, which may be executed by the processor 420 in connection with control and calibration functionality (e.g., as described with an example of FIG. 3). The microphone 410 of the mobile computing device 400 receives the acoustic reference transmissions ("AREFTR") 361 from the individual audio output devices 120, 122, 124, 126. The acoustic reference transmissions 361 can be received as encoded signals 467 ("Enc. Signal"), and may include data that identifies the particular audio output device 120, 122, 124, 126 from which the acoustic reference transmission 361 originated. The processor 420 may execute the device control instructions 441 in order to (i) collect the acoustic reference transmissions 361 from the different audio output devices 120, 122, 124, 126 for a given point in time, and (ii) implement timing analysis component 312 to determine timing parameters 317 reflecting differences in the arrival times 363 of the acoustic reference transmissions 361.

According to some embodiments, the processor 420 may execute the device control instructions 441 in order to determine calibration commands based at least in part on the determined timing parameters 317. Furthermore, the processor 420 may use the network interface 450 to communicate calibration commands to one or more audio output devices 120, 122, 124, 126 on the network 101 of the mobile computing device 400. The calibration commands may include, for example, delay commands ("DC") 323, which cause specific audio output devices 120, 122, 124, 126 to selectively delay or otherwise adjust timing of their respective outputs in order to calibrate the arrival time of a given segment of audio content to the user. As an addition or variation, the calibration commands may include volume commands ("VC") 325 which adjust the volume of individual audio output devices 120, 122, 124, 126 up or down based on, for example, a proximity of the user to one audio output device 120, 122, 124, 126 as opposed to another.

According to some variations, the processor 420 may also execute the device control instructions 441 in order to implement contextual analysis component 314 (as described with an example of FIG. 3) and make contextual determinations 315. From the contextual determinations 315, control commands ("CC") 321 may be communicated to selectively power audio output devices 120, 122, 124, 126 on or off based on the location of the user relative to individual audio output devices. The contextual analysis component 314 may make the contextual determinations 315 based on contextual information, such as, for example, information defining the spacing, leveling, or segmentation (e.g., rooms) of the dwelling of network 101.

As an addition or alternative, the memory 440 may also store user interface instructions ("UI Instruct.") 443. The processor 420 may execute the user interface instructions 443 in order to generate a user interface ("UI") 431 on the display 430. The user interface 431 may provide the user with prompts and other interfaces to facilitate the user in providing input information 301 about the audio output devices 120, 122, 124, 126 that are in use on the network 101. In particular, the input information 301 received through the user interface 431 may include configuration input ("Config. Input") 433, including (i) the group size information 309 (FIG. 3), which identifies a number of audio output devices 120, 122, 124, 126 on the network 101, (ii) device position information 311, including a location indication for one or more of the audio output devices 120, 122, 124, 126, and/or (iii) a selected or preferred layout. In one example, the mobile computing device 400 determines the channel configurations 453 based at least in part on a configuration input of the user. The configuration input may be determined through user interaction with the user interface 431 provided on the display 430.

Still further, the memory 440 may include position logic instructions ("Position Logic Instruct.") 445, which when executed by the processor 420, result in the processor 420 generating channel configurations 453. As described with some other examples, channel configurations 453 may include one or more the following: (i) an audio output device layout or scheme, and/or (ii) a channel assignment for each audio output device 120, 122, 124, 126 on the network 101, based on the selected device layout. The position logic instructions 445 may determine channel configurations 453 based on additional information, such as input information 301 provided from the user, and/or information known about a particular type or model of one or more of the audio output devices 120, 122, 124, 126. For example, a user may enter information about a specific audio output device using the user interface 431, and the capability known for the particular audio output device may favor use of that device for a particular location are channel assignment.

Figure 5:
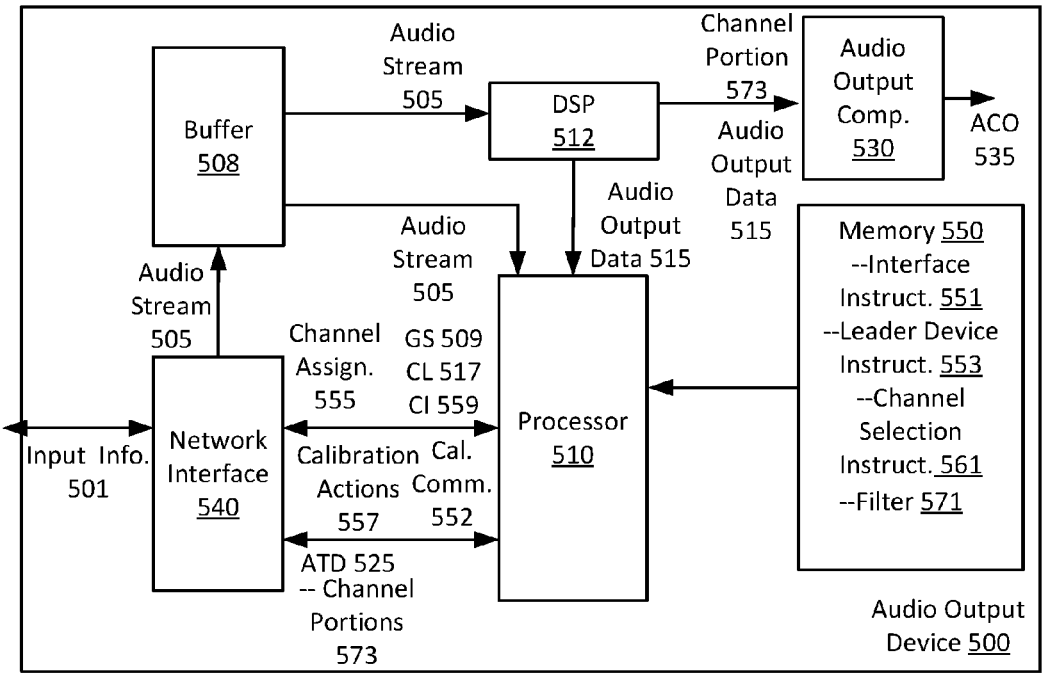
FIG. 5 illustrates an audio output device on which various embodiments may be implemented.

FIG. 5 illustrates an audio output device on which various embodiments may be implemented. In particular, an example of FIG. 5 illustrates an audio output device 500 that may also optionally operate as a leader device (e.g., 120), such as described in the example of FIG. 1.

With reference to FIGS. 1-5, in more detail, the audio output device 500 includes a buffer 508, a processor 510, an audio output component 530, a network interface 540, and a memory 550. In variations, the audio output device 500 includes a digital signal processor (DSP) 512. The memory 550 may store instructions for execution by the processor 510, including interface instructions 551 and/or leader device instructions 553. When operating on the network 101, the processor 510 may execute interface instructions 551 in order to receive an incoming audio stream 505 at the buffer 508 via the network interface 540. In some implementations, (i) at least a portion of the audio stream 505 is directed to the audio output component 530, which generates an audio content output ("ACO") 535, and (ii) transmit at least portions of the audio stream 505 to other audio output devices 120, 122, 124, 126. In some embodiments, the DSP 512 processes the audio stream 505 into audio output data 515, which may, for example, structure the audio stream 505 into delineable channeled portions that may be readily filtered at the playback location. The audio output component 530 may receive audio output data 515 from the DSP 512. In variations, the audio output component 530 receives the audio stream 505 from the buffer 508. Still further, the audio output component 530 may receive a channel portion 573 of the audio stream 505, based on the channel assignment as determined by the processor 510. The audio output component 530 may transform the audio output data 515 (or audio stream 505) into sound which is emitted from the audio output device 500 onto the physical space of the network 101.

Additionally, as a leader, the processor 510 of the audio output device 500 may execute leader device instructions 553 in order to (i) determine and communicate channel assignments 555 to other audio output devices 120, 122, 124, 126 on the network 101, (ii) distribute the audio stream 505 (or portions thereof) to the other audio output devices 120, 122, 124, 126, and/or (iii) implement or otherwise communicate calibration actions 557 that affect the generation of audio output on the other audio output devices 120, 122, 124, 126. In variations, the processor 510 may execute the leader device instructions 553 to utilize and distribute the enhanced form of the audio stream 505 from the DSP 512, shown as the audio output data 515.

The audio output device 500 may also execute the leader device instructions 553 to receive input information 501 from the controller device 110, 300. Among other items, the input information 501 may include group size information ("GS") 509, channel layout information ("CL") 517 (e.g., positioning of the individual audio output devices about a dwelling in accordance with Dolby 5.1/7.1 etc.), and configuration input ("CI") 559. The input information 501 may be received by, for example, user input provided through an interaction with the user interface 310.

In some implementations, the channel assignments 555 may be determined by the controller device 110, 300 and received by the audio output device 500 through the network interface 540. In some variations, the channel assignments 555 may be determined by channel selection instructions 561 executing on the audio output device 500. The channel selection instructions 561 may utilize input information 501, including (i) group size information 509, corresponding to a number of audio output devices 120, 122, 124, 126, (ii) the channel layout information 517, and (iii) a general configuration of the audio output devices 120, 122, 124, 126, provided as configuration input 559. The channel selection instructions 561 utilize the various inputs in order to determine the channel assignments 555 for individual audio output devices 120, 122, 124, 126. The inputs for the channel selection instructions 561 may be received over the network interface 540 from, for example, the mobile computing device 400 as the controller device 110, 300.

Some embodiments provide for the audio output device 500 to distribute, as the leader, audio transmission data ("ATD") 525 to other audio output devices 120, 122, 124, 126 using the network interface 540. Depending on implementation, the audio transmission data 525 may correspond to (i) the full audio stream 505, which may be filtered by the other audio output devices 120, 122, 124, 126 which receive the audio stream 505; (ii) the audio output data 515, which structures the full audio stream 505 into pre-determined and delineable channeled portions that may be readily filtered at the playback location; and/or (iii) separated channel portions 573, which may be individually transmitted to specific audio output devices based on the channel assignment of the audio output devices 120, 122, 124, 126.

In some embodiments, the selection of a leader amongst the audio output devices 120, 122, 124, 126 may be a modal implementation, which may be dynamically implemented by the controller device 110, 300. In alternative modes, the audio output device 120, 122, 124, 126 that is the leader may be replaced by, for example, the source of the audio stream, the access point 102, the mobile computing device 400 acting as the controller device 110, 300 (which may also act as the source of the content), or another one of the audio output devices 120, 122, 124, 126. In other variations, the designation of one audio output device 120, 122, 124, 126 as the leader may be subject to change based on selection logic on the controller device 110, 300. For example, the controller device 110, 300 may execute selection logic to change the leader in response to an event or condition, such as presence of low bandwidth at the originally selected leader device.

According to some embodiments, the audio stream 505 may be received over the network interface 540, then buffered at buffer 508 and processed. The input audio stream 505 may represent a full stream, without any delineation or segmentation of channels from the greater content. The processor 510 (or DSP 512 if used) may execute filtering logic ("filter") 571 in order to create multiple channel portions 573 of the audio stream 505. Each of the channel portions 573 may correspond to one of the channels of the determined channel configuration. Specifically, the audio stream 505 may be filtered into multiple channel portions 573, with each channel portion 573 being designated for a particular channel that is assigned to one of the audio output devices 120, 122, 124, 126 on the network 101. The channel portions 573 of the audio stream 505 may then be transmitted to the other audio output devices 122, 124, 126 using the network interface 540.

With regard to the calibration actions, the audio output device 500 may receive calibration commands ("Cal. Comm.") 552 from the mobile computing device 400, and then implement the calibration commands 552 as calibration actions 557. The calibration actions 557 may correspond to or be based on the calibration commands 552. The calibration actions 557 may be implemented directly through distribution of the audio transmission data 525 or through communication with the other audio output devices 120, 122, 124, 126 via the network interface 540. In some variations, the audio output device 500 receives calibration related measurements and data from the mobile computing device 400, such as the timing parameter 317. In variations, the audio output device 500 may also include logic to determine calibration actions 557 that include or correspond to calibration commands 552 (delay, volume, etc.), based on the measurements and data of the mobile computing device (e.g., different in arrival times for a common audio segment, timing parameters, etc.).

Methodology

Figure 6:
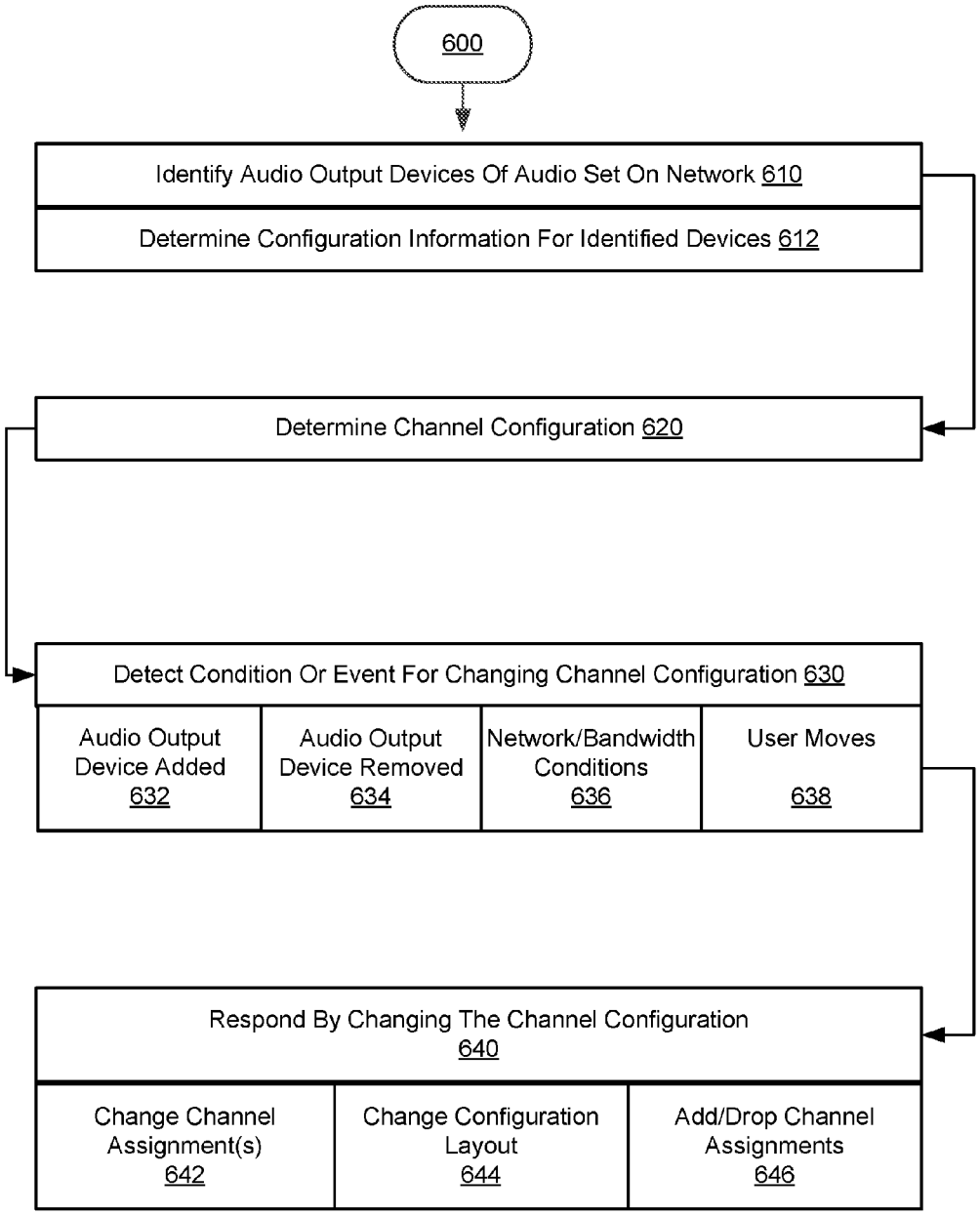
FIG. 6 illustrates a method for dynamically determining and implementing channel configurations for a network-based audio system, according to various embodiments.
Figure 7:
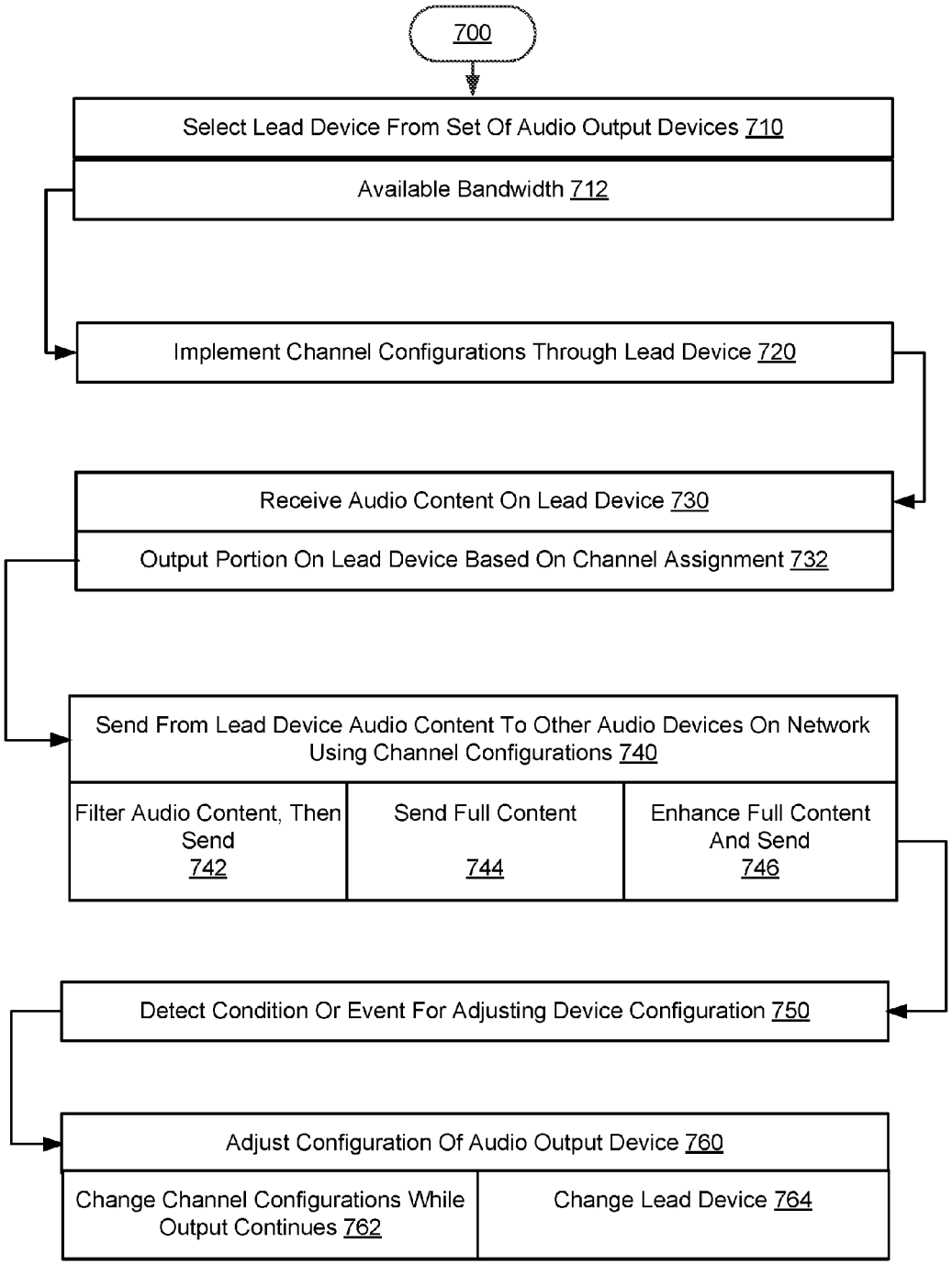
FIG. 7 illustrates a method for operating an audio output device as a leader device when distributing audio content to other audio output devices on a network, according to various embodiments.
Figure 8:
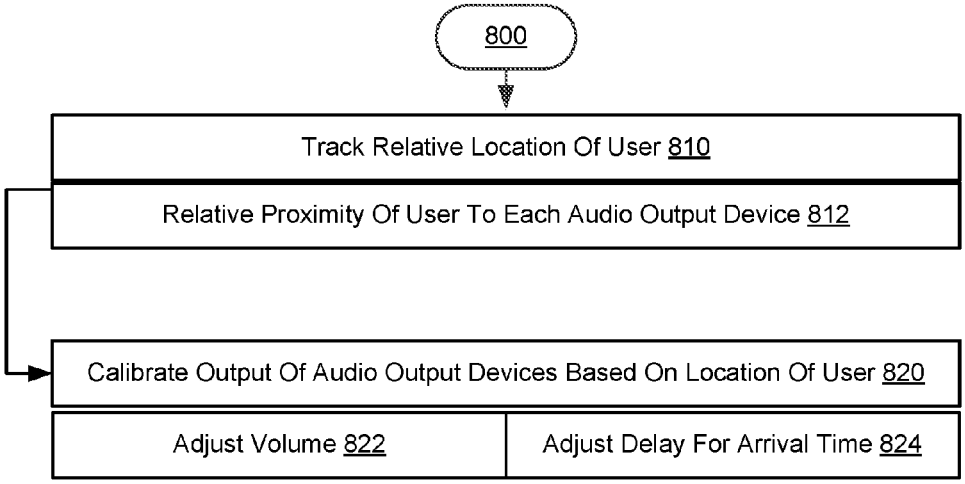
FIG. 8 illustrates a method for calibrating an output of multiple audio output components on a network based on a relative position of a user, according to various embodiments.
Figure 9:
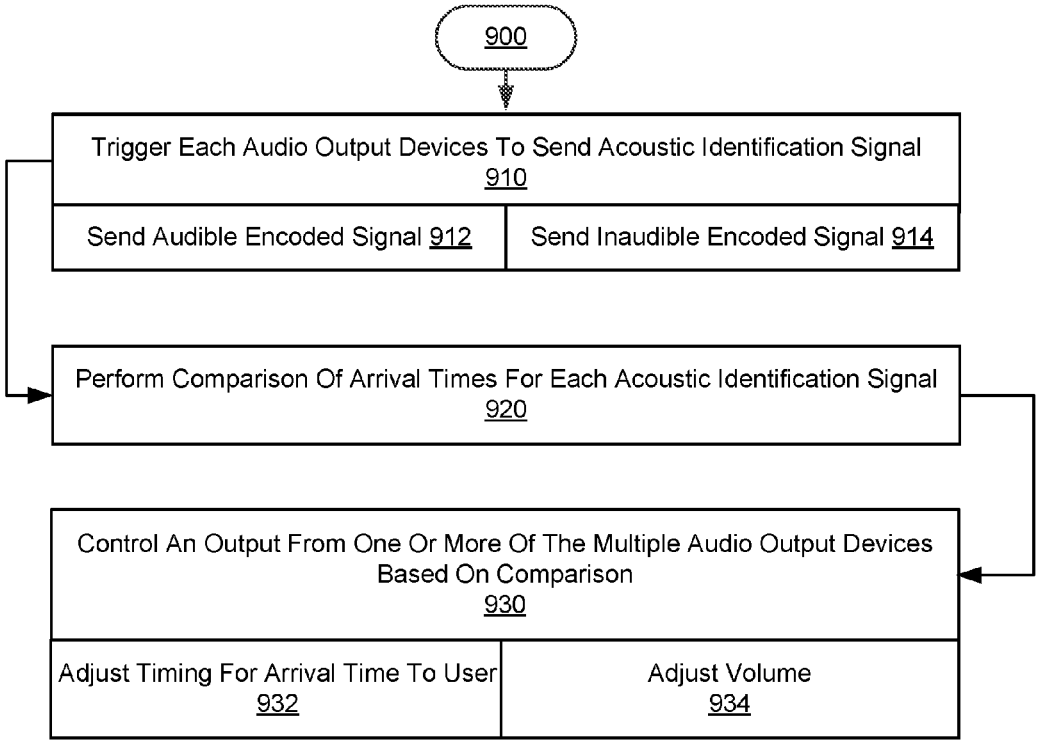
FIG. 9 illustrates a method for calibrating an audio output device based on a position of a user, in accordance with various embodiments.
Figure 10:
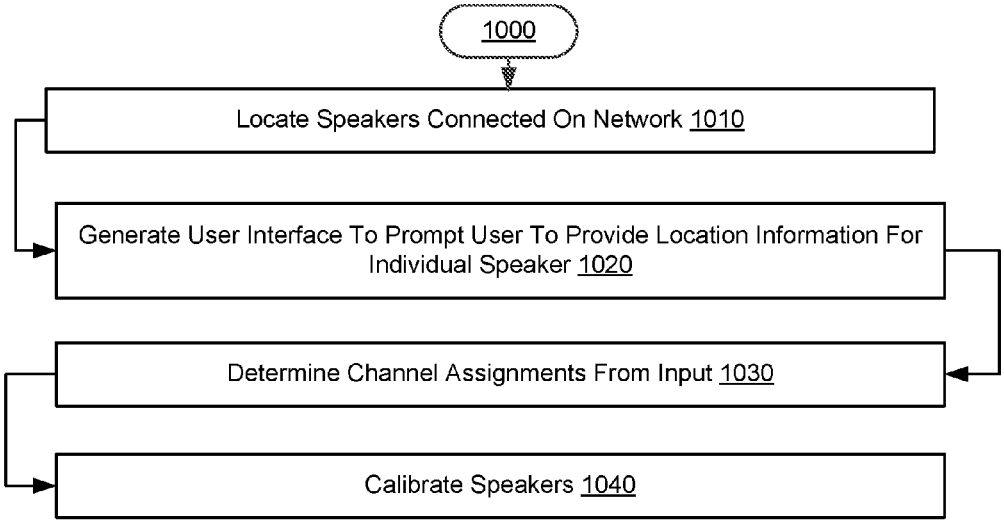
FIG. 10 illustrates a method for implementing a user interface to initiate dynamic configuration of a network-based audio system, according to various embodiments.

FIG. 6 illustrates a method 600 for dynamically determining and implementing channel configurations for a network-based audio system, according to various embodiments. FIG. 7 illustrates a method 700 for operating an audio output device as a leader device when distributing audio content to other audio output devices on a network, according to various embodiments. FIG. 8 illustrates a method 800 for calibrating an output of multiple audio output components on a network based on a relative position of a user, according to various embodiments. FIG. 9 illustrates a method 900 for calibrating an audio output device based on a position of a user, in accordance with various embodiments. FIG. 10 illustrates a method 1000 for implementing a user interface to initiate dynamic configuration of a network-based audio system, according to various. Example methods such as provided by FIG. 6 through FIG. 10 may be performed using components such as described with examples of FIG. 1 through FIG. 5. Accordingly, reference may be made to elements of FIG. 1 through FIG. 5 for purpose of describing suitable components for performing a step or sub-step being described.

With reference to FIG. 1, a set of audio output devices 120, 122, 124, 126 for a given network 101 may be identified by a controller device 110, 300 (610). In some implementations, the audio output devices 120, 122, 124, 126 may be identified by input information from a user. In some implementations, input information 301 may be provided through the user interface 310 of the controller device 110, which may be provided on a mobile computing device 400. In a variation, the audio output devices 120, 122, 124, 126 that are connected on the network 101 may be identified programmatically, using, for example, object tracking and detection technology. For example, the audio output devices 120, 122, 124, 126 of the network 101 may be equipped with a receiver for receiving transmissions of ultrasonic acoustic waves. The controller device 110, 300 may transmit the ultrasonic acoustic waves to the individual audio output devices 120, 122, 124, 126, and the audio output devices 120, 122, 124, 126 may include programming or logic to detect the ultrasonic acoustic waves. The ultrasonic acoustic waves may provide for use of a dimensional parameter based on the received transmission.

Additional configuration information may also be determined for the identified audio output devices 120, 122, 124, 126 of the network 101 (612). The additional configuration information may include a selected device layout (e.g., 5.1 arrangement, 7.1 arrangement etc.), as well as a relative location of the individual audio output devices 120, 122, 124, 126 about a physical region of the network 101. For example, a user may specify the approximate location of individual audio output devices 120, 122, 124, 126 using a virtual interface of a generic room, provided through the user interface 310 of the controller device 110, 300.

Once the audio output devices 120, 122, 124, 126 are identified and other configuration information is determined, the channel configuration for the audio output devices 120, 122, 124, 126 may be determined (620). As described with other examples, the channel configuration may specify channel assignment for identified audio output devices 120, 122, 124, 126. In some examples, the channel configuration may be determined from, for example, the mobile computing device 400 on which the controller device 110, 300 is implemented. In a variation, the channel configuration may be determined from the audio output device 120, 122, 124, or 126 that is selected as the leader by the user and/or controller device 110, 300. Still further, in another variation, the channel configuration may be determined from multiple components, including the controller device 110, 300 or audio output device 120, 122, 124, or 126 that operates as the leader.

According to some embodiments, when the audio output devices 120, 122, 124, 126 are in use, an event or condition may be detected requiring a dynamic or on-the-fly change to the configuration of the audio output devices (630). In some implementations, the occurrence of the condition or event may correspond to a new audio output device being introduced to the network 101 (632). Alternatively, the condition or event may correspond to one of the existing audio output devices 120, 122, 124, 126 being removed or taken down from the network 101 (634). Still further, there may be a change in a network bandwidth (636), resulting in some audio output devices 120, 122, 124, 126 having their bandwidth changed for better or worse as compared to other audio output devices 120, 122, 124, 126. As another variation, the audio content being played by the various audio output devices 120, 122, 124, 126 may change. For example, the channel configuration may merit change if the audio content shifts from having a relatively normal or low bit count to having a relatively high bit count.

Still further, the network condition or event may correspond to the user moving about a region where the audio output devices 120, 122, 124, 126 are in use and present (638). As described, some embodiments provide that when the user moves about, the movement of the user is detected, and one or more calibration actions may take place to equalize the experience of audio generated by the audio output devices 120, 122, 124, 126 on the network 101. As an addition or variation, one response to the user moving in the physical region of the audio output devices 120, 122, 124, 126 may be that the channel configuration is altered to accommodate the movement of the user.

In response to detecting the event or condition, the controller device 110, 300 and/or audio output device 120, 122, 124, or 126 that is the leader may respond by changing the channel configuration (640). More specifically, in some implementations, the channel configuration may be changed by altering the various channel assignments (642) to accommodate more or fewer audio output devices 120, 122, 124, 126 (in the event that an audio output device is added or subtracted from the network 101). Additionally the channel configuration can be changed by altering a layout so as to favor the change to, for example, the number of the audio output devices 120, 122, 124, 126 (644). Still further, the change in channel configuration may be responsive to the addition or deletion of the channel assignment (646).

With reference to FIG. 7, a leader of the audio output devices 120, 124, or 126 is selected (710). The selection of the audio output device 120, 122, 124, or 126 that is the leader may also be dynamic, in that some variations provide that the audio output device that is the leader may be selected and/or changed by the controller device 110, 300. By way of example, the audio output device 120, 122, 124, or 126 that is selected as the leader may change as a result of variations to the bandwidth available to that device (712), particularly as compared to the other audio output devices 120, 122, 124, 126 on the network 101.

According to some embodiments, some or all of the channel configurations may be implemented through the audio output device 120, 122, 124, or 126 that is the leader (720). Still further, the audio output device 120, 122, 124, or 126 that is the leader and/or controller device 110, 300 may combine to implement the various channel configurations for all of the audio output devices 120, 122, 124, 126. The channel configurations may also be determined from the controller device 110, 300 and then communicated to the audio output device 120, 122, 124, or 126 that operates as the leader. As described with other examples, the channel configurations may include channel assignments for each of the audio output devices 120, 122, 124, 126. In some variations, the channel configurations may also include other information, such as a presumed layout for the audio output devices 120, 122, 124, 126.

In operation, audio content may be received on the audio output device 120, 122, 124, or 126 that is the leader for distribution to other audio output devices 120, 122, 124, 126 of the network 101 (730). While receiving and distributing the audio content, the leader audio output device 120, 122, 124, or 126 may also output a portion of the audio content that is assigned to its own channel (732).

In some variations, the audio content is received on the audio output device 120, 122, 124, 126 and then sent to the other audio output devices 120, 122, 124, 126 that are on the network 101 in accordance with the determined channel configuration (740). In some implementations, the audio output device 120, 122, 124, or 126 that acts as the leader operates to filter the audio content for individual channels, and then sends the portion of the filtered audio to each of the other audio output devices 120, 122, 124, 126 based on the channel assignment (742). As an addition or variation, the full audio content may be sent from the audio output device 120, 122, 124, 126 to other audio output devices 120, 122, 124, 126 of the network 101. In such an implementation, the audio output devices 120, 122, 124, 126, which receive the full audio content from the leader perform the filtering at the point of output, and further at the time just proceeding output (744). Further along the lines, some variations provide for the audio content to be augmented, and more specifically, processed on either the controller device 110, 300 or audio output device 120, 122, 124, or 126 that is the leader for purpose of generating structure in the audio content (746). The added structure may facilitate the other audio output devices 120, 122, 124, 126 in performing filtering operations on a full audio content.

As mentioned with respect to the method 600, an event or condition is detected which initiates a change in the channel configuration and or other selections (e.g., selection of the particular leader device, or motive implementation etc.) (750). By way of example, the event or condition may correspond to a change in the bandwidth of some or all of the audio output devices 120, 122, 124, 126, a change in the content being outputted (e.g., the bit value of the content), the addition or subtraction of an audio output device from the network 101, and/or movement by the user sufficient to trigger calibration actions.

In response to a detected event or condition, one or more processes may be triggered to dynamically adjust the channel configurations and other selections made by either the controller device 110, 300 or audio output device 120, 122, 124, or 126 operating as the leader (760). In some implementations, the controller device 110, 300 and/or audio output device 120, 122, 124, or 126 that is the leader may respond by adjusting the channel configurations of the respective audio output devices while the output continues on the network (762). The change in the channel configurations may include (i) changing the channel assignment of a given output device 120, 122, 124, 126, (ii) creating or eliminating a channel assignment based on the addition or subtraction of an audio output device 120, 122, 124, 126 to the network 101, and/or (iii) changing a selected layout for the audio output device 120, 122, 124, 126 based on any one or more of user input, a change in the number of audio output devices 120, 122, 124, 126, or other criteria. The channel configurations may be changed dynamically, so that the change to the channel configurations is relatively seamless and not interruptive to the listening experience of the user. For example, one or more changes may be made to the channel configurations while at least one or more of the audio output devices 120, 122, 124, 126 continue to output audio content.

Other changes that may be implemented dynamically include the selection of the audio output device 120, 122, 124, or 126 that is to operate as the leader (764). For example, the audio output device 120, 122, 124, or 126 that operates as the leader may implement a mode change so that the other audio output devices 120, 122, 124, 126 receive the audio content from the controller device 110, 300 or source, and not from the leader audio output device. Likewise another mode change may be made to select a new audio output device 120, 122, 124, or 126 as the leader, based on criteria such the amount of bandwidth available to the selected audio output device. Thus, for example, the selection of the audio output device 120, 122, 124, or 126 that acts as the leader may be dynamic and made on the fly. Likewise, other selections that may be made dynamically include: (i) the selection of the mode of operation, such as whether any one of the audio output device 120, 122, 124, 126 may be used as leader after having been leader in the same session, (ii) whether the audio content is filtered or structured (e.g. with or without leader device), and/or (iii) whether the audio content is to be filtered or augmented for the other audio output devices 120, 122, 124, 126 before transmission.

With reference to FIGS. 1-8, a location of a user may be tracked within the network environment based on measurements made by a mobile computing device 400 of the user when audio is being outputted by the audio output devices 120, 122, 124, 126 (810). More specifically, a relative proximity of the mobile computing device 400 (which presumably is carried by the user) to one or more audio output devices 120, 122, 124, 126 on the network 101 may be approximated (812). Based on the determined relative position of the user, as indicated by the user's mobile computing device, one or more output characteristics of the audio content may be calibrated to accommodate the presumed relative proximity of the user to the audio output devices 120, 122, 124, 126 of the network 101 (820). As mentioned with other examples, the calibration may include controlling or otherwise adjusting the volume of one or more audio output devices 120, 122, 124, 126 (822). As an addition or variation, the calibration may include adjusting or inserting delays into the output of audio content from one or more audio output devices 120, 122, 124, 126 (824). The insertion of delays may be based on, for example, a proximity determination as between select audio output devices 120, 122, 124, 126 and the user as compared to other devices connected to the same network 101.

With reference to FIGS. 1-9, each audio output device 120, 122, 124, 126 is triggered to send an acoustic identification signal to the controller device 110, 300 (e.g., mobile computing device 400) (910). The acoustic identification signal may be an audible and encoded transmission that identifies the source of the acoustic transmission (912). In variations, the acoustic identification signal may be an inaudible and encoded transmission that is detectable to resources (e.g. microphone) of the mobile computing device on which the controller device 110, 300 is implemented (914).

The mobile computing device 400 may perform a comparison of arrival times for the acoustic identification signal transmitted from each audio output device 120, 122, 124, 126 (920). Each acoustic identification signal may include a particular segment of the audio content being played back. For example, each acoustic identification signal may represent one or two frames of the audio content. Each audio output device 120, 122, 124, 126 may transmit an acoustic identification signal for a common portion of the audio content being outputted on that device. The acoustic identification signal may provide a mechanism for the mobile computing device 400 of the user to make measurements that are indicative of a relative position of the mobile computing device to one or more other audio output devices 120, 122, 124, 126.

In some implementations, the mobile computing device 400 includes software or other programmatic functionality to time stamp the incoming audio signal, extract the encoded identifier, and store the time stamp and identifier of the incoming audio signal for subsequent analysis. Each audio transmission may be encoded to coincide with a particular instance in time in the audio content. For example, a particular audio frame in a song may be selected for encoding by each audio output device 120, 122, 124, 126, and each audio output device 120, 122, 124, 126 may then output its portion of the audio frame when the song is being played. The microphone on the mobile computing device 400 may detect the encoded audio signals from each audio output device 120, 122, 124, 126 and then record the arrival times and the identifier for each signal. Once all the transmissions for a given instant are recorded, a comparison of arrival times may be performed. The comparison may identify variation in the audio output device's arrival time, with the assumption that sound travels about 1 foot in 1 millisecond. If the arrival times reflect a discrepancy of more than 1 millisecond, then the arrival times indicate the mobile computing device 400 has moved a correlated amount. More specifically, the comparison of arrival times may indicate a proximity of the mobile computing device 400 of the user (on which the control device 110, 300 is implemented) relative to one or more of the audio output devices 120, 122, 124, 126 that are connected to the network 101.

An output from one or more of the audio output devices 120, 122, 124, 126 may be controlled in order to calibrate the audio output from all of the audio output devices, as well as to harmonize the user's experience (930). As described, some embodiments provide for the calibration actions to include (i) adjusting the timing for individual audio output devices 120, 122, 124, 126 so that the arrival time of multiple audio output devices is substantially the same, at least from the perspective of the user (932); and (ii) adjusting the volume of an individual audio output device 120, 122, 124, 126 so that the user experiences each of the device as being equal in volume, regardless of the distance between the user and the particular audio output device 120, 122, 124, 126 (934).

With reference to FIGS. 1-10, a user interface 310 may be generated on a mobile computing device 400 on which the controller device 110, 300 is implemented, in order to enable the user to provide some or all of the configuration inputs for determining the channel configurations, as well as various other dynamic determinations (e.g., mode of operation, selection of the leader device, etc.).

According to various embodiments, the audio output devices 120, 122, 124, 126 of the network 101 may be located and linked (1010). As mentioned with other examples, each audio output device 120, 122, 124, 126 may be capable of network communications, such as wireless communication (e.g., peer-to-peer wireless communications such as provided by Wi-Fi Direct). The audio output devices 120, 122, 124, 126 may be linked, regardless of manufacturer or primary purpose. Still further, in variations, the audio output devices 120, 122, 124, 126 may be heterogeneous, in terms of manufacturer, functionality, programmatic resources, and/or primary resource.

The user interface 310 may be generated to prompt or otherwise guide the user into providing information about the audio output devices 120, 122, 124, 126 that are connected on the network 101 (1020). For example, a number of audio output devices 120, 122, 124, 126 that are connected to the network 101 may be specified by user input provided through the user interface 310. Furthermore, the user may identify each audio output device 120, 122, 124, 126, and further identify a relative location of each audio output device 120, 122, 124, 126 in the user's dwelling or network space. For example, the user may be provided with the user interface 310 that depicts a general outline of a room (e.g., FIG. 11). The outline may be generic or include user-specified features (e.g., extra wall, rounded walls, etc.) The user may identify specific audio output devices 120, 122, 124, 126 in the user's set, and then further indicate a location in the space or dwelling where the specific audio output devices are positioned.

Once the number of audio output devices and their respective location are generally identified, functionality provided by the audio output devices 120, 122, 124, 126 may trigger determination of the channel assignments (1030). As described with other embodiments, in determining channel assignments, the number of audio output devices 120, 122, 124, 126, the location of each audio output device, and the selected layout or configuration may serve as inputs for determining the channel assignments.

Once channel assignments and locations are determined, the calibration may be performed based on the relative location of the user (1040). An initial calibration may, for example, calibrate the arrival time and volume level of the media content output from each audio output device 120, 122, 124, 126 based on an initial location of the user relative to the audio output devices. Subsequently the user may elect to have calibration performed periodically or repeatedly so to track the steps of the user in the dwelling or space.

Figure 11:
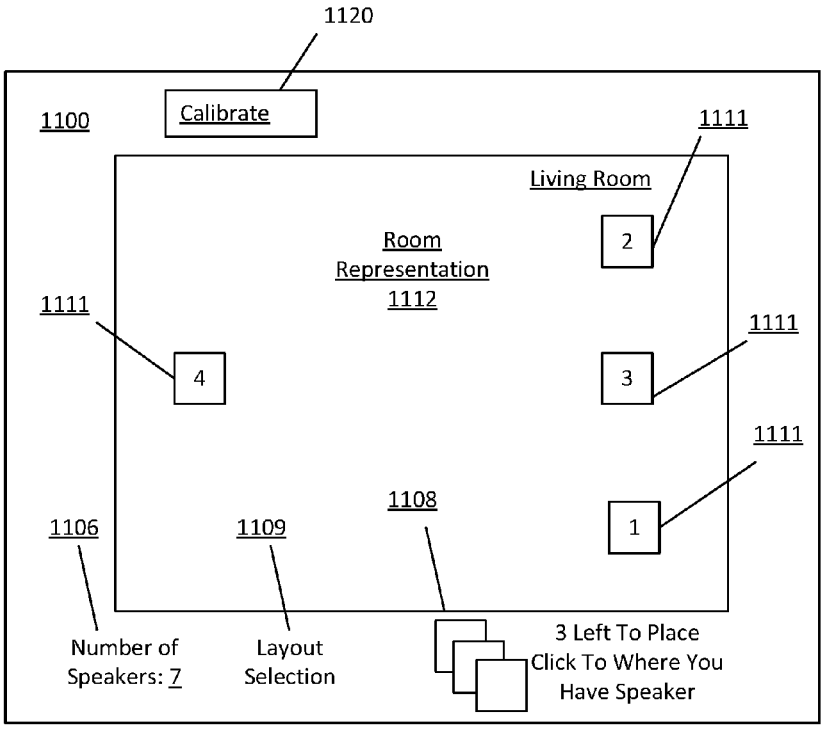
FIG. 11 illustrates a user interface for enabling speaker selection and assignment, according to various embodiments.

FIG. 11 illustrates a user interface 1100 for enabling speaker selection and assignment according to various embodiments. The user interface 1100 may be generated from an application or programming component executing on the mobile computing device 400. The user interface 1100 can, for example, include input functionality, including (i) number select feature 1106 for enabling the user to specify a number of audio output devices 120, 122, 124, 126 that are to be in use, and (ii) a layout selection 1109 feature to enable the user to select a preferred layout. Additionally, the user may be provided with placement functionality 1108 to enable the user to specify the location of individual audio output devices 120, 122, 124, 126 within a graphic room representation 1112. (For example, the room representation 1112 may be a graphic representation of a room.) The user may, for example, click and drag device representations 1111 onto the room representation 1112 to approximate the general location and orientation of the audio output devices 120, 122, 124, 126.

Once the audio output devices 120, 122, 124, 126 are positioned, the user may select the calibration feature 1120 to initiate a calibration process such as described with the method 1000. The calibration feature 1120 may be triggered once to locate the user relative to the audio output devices 120, 122, 124, 126. The calibration feature 1120 may correct any imprecision or error by the user in specifying the location of individual audio output devices 120, 122, 124, 126. Additionally, the calibration feature may be implemented in a track mode, where the calibration is performed repeatedly to track whether the user moves.

Although illustrative embodiments have been described in detail herein with reference to the accompanying drawings, variations to specific embodiments and details are encompassed by this disclosure. It is intended that the scope of embodiments described herein be defined by claims and their equivalents. Furthermore, it is contemplated that a particular feature described, either individually or as part of various embodiments, may be combined with other individually described features, or parts of other embodiments. Thus, absence of describing combinations should not preclude the inventor(s) from claiming rights to such combinations.

What is claimed is:

1. A method for outputting audio content over a network, the method comprising:

assigning each of a plurality of audio output devices in the network to a corresponding channel;

configuring each of the plurality of audio output devices to output at least a portion of the audio content based at least in part on the assigned channel; and during playback of the audio content, dynamically changing the channel assignments based at least in part on changes to the plurality of audio output devices.

2. The method of claim 1, wherein the channel assignment for each of the plurality of audio output devices is based on at least one of a number of audio output devices available in the network, a relative position of each of the plurality of audio output devices in the network, or a predetermined configuration scheme.

3. The method of claim 1, wherein the dynamically changing comprises:

detecting an addition of a new audio output device in the network; and assigning the new audio output device to a new channel or an existing channel assigned to one of the plurality of audio output devices.

4. The method of claim 3, further comprising:

reassigning one of the plurality of audio output devices to the new channel.

5. The method of claim 1, wherein the dynamically changing comprises:

detecting a removal or failure of one of the plurality of audio output devices; and reassigning at least one of the plurality of audio output devices to a different channel upon detecting the removal or failure of the one of the plurality of audio output devices.

6. The method of claim 1, wherein the dynamically changing comprises:

reassigning one or more of the plurality of audio output devices to a new or different channel.

7. The method of claim 1, further comprising:

detecting a bandwidth of each of the plurality of audio output devices.

8. The method of claim 7, further comprising:

transmitting the audio content to a first audio output device having the highest bandwidth among the plurality of audio output devices; and enabling the first audio output device to distribute at least a portion of the audio content to others of the plurality of audio output devices.

9. The method of claim 1, wherein the configuring comprises:

transmitting the audio content to each of the plurality of audio output devices; and instructing each of the plurality of audio output devices to filter the audio content for the portion to be output by the corresponding audio output device based on the assigned channel.

10. The method of claim 1, further comprising:

detecting changes in a location of a user; and dynamically adjusting one or more audio output characteristics of at least one of the plurality of audio output devices based on the changes in the location of the user.

11. The method of claim 10, wherein the one or more audio output characteristics includes at least one of a delay or volume of audio signals output by the at least one of the plurality of audio output devices.

12. A system for outputting audio content over a network, the system comprising:

one or more processors; and a memory storing instructions that, when executed by the one or more processors, cause the system to:

assign each of a plurality of audio output devices in the network to a corresponding channel;

configure each of the plurality of audio output devices to output at least a portion of the audio content based at least in part on the assigned channel; and during playback of the audio content, dynamically change the channel assignments based at least in part on changes to the plurality of audio output devices.

13. The system of claim 12, wherein the channel assignment for each of the plurality of audio output devices is based on at least one of a number of audio output devices available in the network, a relative position of each of the plurality of audio output devices in the network, or a predetermined configuration scheme.

14. The system of claim 12, wherein execution of the instructions to dynamically change the channel assignments causes the system to:

detect an addition of a new audio output device in the network; and assign the new audio output device to a new channel or an existing channel assigned to one of the plurality of audio output devices.

15. The system of claim 12, wherein execution of the instructions to dynamically change the channel assignments causes the system to:

detect a removal or failure of one of the plurality of audio output devices; and reassign at least one of the plurality of audio output devices to a different channel upon detecting the removal or failure of the one of the plurality of audio output devices.

16. The system of claim 12, wherein execution of the instructions to dynamically change the channel assignments causes the system to:

reassign one or more of the plurality of audio output devices to a new or different channel.

17. The system of claim 12, wherein execution of the instructions further causes the system to:

detect a bandwidth of each of the plurality of audio output devices;

transmit the audio content to a first audio output device having the highest bandwidth among the plurality of audio output devices; and enable the first audio output device to distribute at least a portion of the audio content to others of the plurality of audio output devices.

18. The system of claim 12, wherein execution of the instructions to configure each of the plurality of audio output devices causes the system to:

transmit the audio content to each of the plurality of audio output devices; and instruct each of the plurality of audio output devices to filter the audio content for the portion to be output by the corresponding audio output device based on the assigned channel.

19. The system of claim 12, wherein execution of the instructions further causes the system to:

detect changes in a location of a user; and dynamically adjust one or more audio output characteristics of at least one of the plurality of audio output devices based on the changes in the location of the user.

20. A non-transitory computer-readable medium storing instructions that, when executed by one or more processors of an audio output system, cause the system to:

assign each of a plurality of audio output devices in a network to a corresponding channel;

configure each of the plurality of audio output devices to output at least a portion of audio content based at least in part on the assigned channel; and during playback of the audio content, dynamically change the channel assignments based at least in part on changes to the plurality of audio output devices.

* * * * *